US007152671B2

(12) United States Patent
Shibagaki et al.

(10) Patent No.: US 7,152,671 B2
(45) Date of Patent: Dec. 26, 2006

(54) EXHAUST GAS HEAT EXCHANGER

(75) Inventors: Kazuhiro Shibagaki, Kariya (JP); Akihiro Maeda, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/039,667

(22) Filed: Jan. 20, 2005

(65) Prior Publication Data

US 2005/0121179 A1 Jun. 9, 2005

Related U.S. Application Data

(62) Division of application No. 10/189,612, filed on Jul. 3, 2002.

(30) Foreign Application Priority Data

Jul. 16, 2001 (JP) ..... 2001-215822

(51) Int. Cl.
*F28F 1/04* (2006.01)
*B23P 15/26* (2006.01)

(52) U.S. Cl. ..... 165/177; 165/157; 165/172; 29/890.053

(58) Field of Classification Search ..... 165/177, 165/153, 157, 158, 162, 173, 172; 138/168; 29/890.049, 890.053
See application file for complete search history.

(56) References Cited

U.S. PATENT DOCUMENTS 2,912,749 A * 11/1959 Huggins et al. ..... 29/890.039
3,053,511 A 9/1962 Godfrey
3,165,152 A 1/1965 Jones
3,212,572 A * 10/1965 Otto ..... 165/166
3,907,032 A 9/1975 DeGroote et al.
4,029,146 A 6/1977 Hart et al.
4,125,153 A 11/1978 Stoneberg
4,501,321 A 2/1985 Real et al.
4,681,155 A * 7/1987 Kredo ..... 165/76
4,805,693 A 2/1989 Flessate
5,185,925 A 2/1993 Ryan et al.
5,441,105 A 8/1995 Brummett et al.
6,192,977 B1 2/2001 Dey et al.
6,209,202 B1 * 4/2001 Rhodes et al. ..... 29/890.053
6,257,483 B1 7/2001 Inaba
6,293,337 B1 9/2001 Strahle et al.
6,640,886 B1 * 11/2003 Lamich ..... 165/174

FOREIGN PATENT DOCUMENTS

JP 2000-205776 7/2000
JP 2001-33187 2/2001

* cited by examiner

*Primary Examiner*—Tho Duong
(74) *Attorney, Agent, or Firm*—Harness, Dickey & Pierce, PLC

(57) ABSTRACT

A tube 101 is constituted by a pair of plates 111*a*, 111*b* which are fitted with each other in such a manner as to put an inner fin 101*b* between the plate 111*a* and the plate 111*b*. Differences in level 111*c* are formed on the second plate 111*b*, which fits inside, which differences in level each protrude inwardly by a distance equal to the thickness of the first plate 111*a*, whereby the outer wall surface of the tube 101 is made substantially level thereover. A gap which is formed between the outer wall surface of the tube 101 and a core plate, when the tube is passed through the core plate, can be as small as possible whereby the brazing properties can be improved.

5 Claims, 8 Drawing Sheets

EXHAUST GAS HEAT EXCHANGER

BACKGROUND OF THE INVENTION

1. Field of the Invention

The present invention relates to an exhaust gas heat exchanger, for performing heat exchange between exhaust gases produced when fuel is burnt in an engine and a cooling fluid such as water and, more particularly, to an exhaust gas heat exchanger for cooling exhaust gases for an EGR (exhaust gas recirculation) system (hereinafter referred to as an "EGR-gas heat exchanger").

2. Description of the Related Art

As a conventional EGR-gas heat exchanger, an EGR-gas heat exchanger is described, for example, in Japanese Unexamined Patent Publication No. 2001-33187 (Kokai). The heat exchanger is constituted by a plurality of stacked tubes which are received in the interior of a tank. The tank is closed with end plates (core plates) and the tubes are secured to the core plates. Connected to the tank are an coolant inlet pipe and an coolant outlet pipe, whereby coolant flows into the tank to remove heat from exhaust gases which pass through the tubes.

It is generally known, as one of means for improving the heat exchange capacity of a heat exchanger, to provide inner fins in tubes of the heat exchanger. Known generally, as a method for producing such a tube, is a method comprising the steps of, for example, inserting an inner fin in a welded tube, bringing the tube into close contact with the inner fin by applying an external force to the tube, and brazing the inner fin to the tube.

Incidentally, with an EGR-gas heat exchanger, an Ni system brazing material is used to braze respective members in order to prevent corrosion caused by condensate produced when exhaust gases are cooled. In general, a brazing material in a paste form is used as the Ni system brazing material and is thinly applied to portions to be joined together.

Thus, in the event that the aforesaid production method is used, in which the inner fins are inserted into the tubes, the applied brazing material is stripped off when the inner fin is inserted, leading to a possibility that sufficient brazing material cannot be provided between the tube and the inner fin.

To cope with this problem, the inventor, et al. produced, by way of a trial, and studied a tube 1, as shown in FIG. 8, which is constituted by a pair of plates 2, 3 adapted to fit with each other in such a manner as to put an inner fin 4 between the plate 2 and the plate 3, as a tube for an EGR-gas heat exchanger in which an inner fin is accommodated.

Since the tube shown in FIG. 8 is constructed such that the pair of plates 2, 3 fit with each other in such a manner as to put the inner fin 4 between the plate 2 and the plate 3, while the aforesaid stripping off of the brazing material due to assembling the inner fin 4 to the tube 1 can be prevented, a difference in level corresponding to the thickness of the outer plate 2 is produced on the external wall surface of the tube 1. It has been made clear that due to this, when the tube 1 is passed through a core plate (not shown) a gap corresponding to the difference in level is produced between an edge of an opening in the core plate and the tube 1 and hence a failure in brazing is caused. Then, when a failure in brazing occurs between the core plate and the tube 1 there occurs a risk that there is caused a leakage between an exhaust gas passage and a coolant passage which are partitioned by the core plate.

SUMMARY OF THE INVENTION

An object of the invention is to obtain good brazing properties for an EGR-gas heat exchanger using therein tubes which are each constructed by a pair of plates adapted to fit with each other.

With a view to attaining the object, the invention adopts the following technical means. According to a first aspect of the invention, the tube has first and second plates which each have a substantially U-shaped cross section and which are caused to fit with each other in such a manner as to face each other and an inner fin disposed in the interior of the tube for promoting heat exchange between exhaust gases and coolant. The second plate fits in the first plate in such a manner that the former is disposed in the inside of the latter, and a difference in level is formed at each of fitting portions of the second plate over which the first plate fits which difference in level is substantially equal in height to the thickness of the first plate and protrudes inwardly in the tube.

According to the first aspect of the invention, as the difference in level is formed on each side of the second plate which is substantially equal in height to the thickness of the first plate and which protrudes inwardly in the tube, no difference in level is formed between the fitting portion where the second plate fits in the first plate and an external wall surface of the second plate, and an external wall surface of the tube becomes substantially level thereover. Due to this, a gap generated between the external wall surface of the tube and an edge of an opening in the core plate can be made small, whereby the implementation of brazing can be ensured.

In addition, according to a second aspect of the invention, the tube has first and second plates which each have a substantially U-shaped cross section and which are caused to fit with each other in such a manner as to face each other and an inner fin disposed in the interior of the tube for promoting heat exchange between exhaust gases and coolant. The first plate fits on the outside of the second plate, and side edge portions of the first plate which fit on the second plate are configured so as to follow bent portions of the second plate which result from bending corresponding portions of the second plate.

According to the second aspect of the invention, as the portions of the first plate where the first plate fits on the second plate are configured so as to follow the bent portions of the second plate which result from bending the corresponding portions of the second plate, there is formed no difference in level between the fitting portions where the second plate fits in the first plate and an external wall surface of the second plate, an external wall surface of the tube becomes substantially level thereover. Due to this, a gap generated between the external wall surface of the tube and an edge of an opening in the core plate can be made small, whereby the implementation of brazing can be ensured.

According to a third aspect of the invention, the number of components can be reduced by making the first and second plates identical to each other in configuration.

According to a fourth aspect of the invention, as portions of the second plate on which the first plate fits are bent upwardly, even if exhaust gases are cooled to produce a condensate that remains within the tube, as the condensate so remaining does not reach to contact the fitting portions where the first and the second plates are brazed to each other, the generation of corrosion that would result from the remaining condensate can be suppressed, the resistance to corrosion thereby being improved.

According to a fifth aspect of the invention, in a case where the invention is applied to an exhaust gas heat exchanger in which the inner fin and the tube are brazed to each other using a brazing material of an Ni system applied to joining portions between the inner fin and the tube, the stripping off of the brazing material at a stage of preliminary assembling prior to brazing can be prevented by constructing the tube such that the inner fin is put between the first and second plates, thereby making it possible to reduce a risk of failure in brazing.

The present invention may be more fully understood from the description of preferred embodiments of the invention set forth below, together with the accompanying drawings.

DESCRIPTION OF PREFERRED EMBODIMENTS

Figure 1:
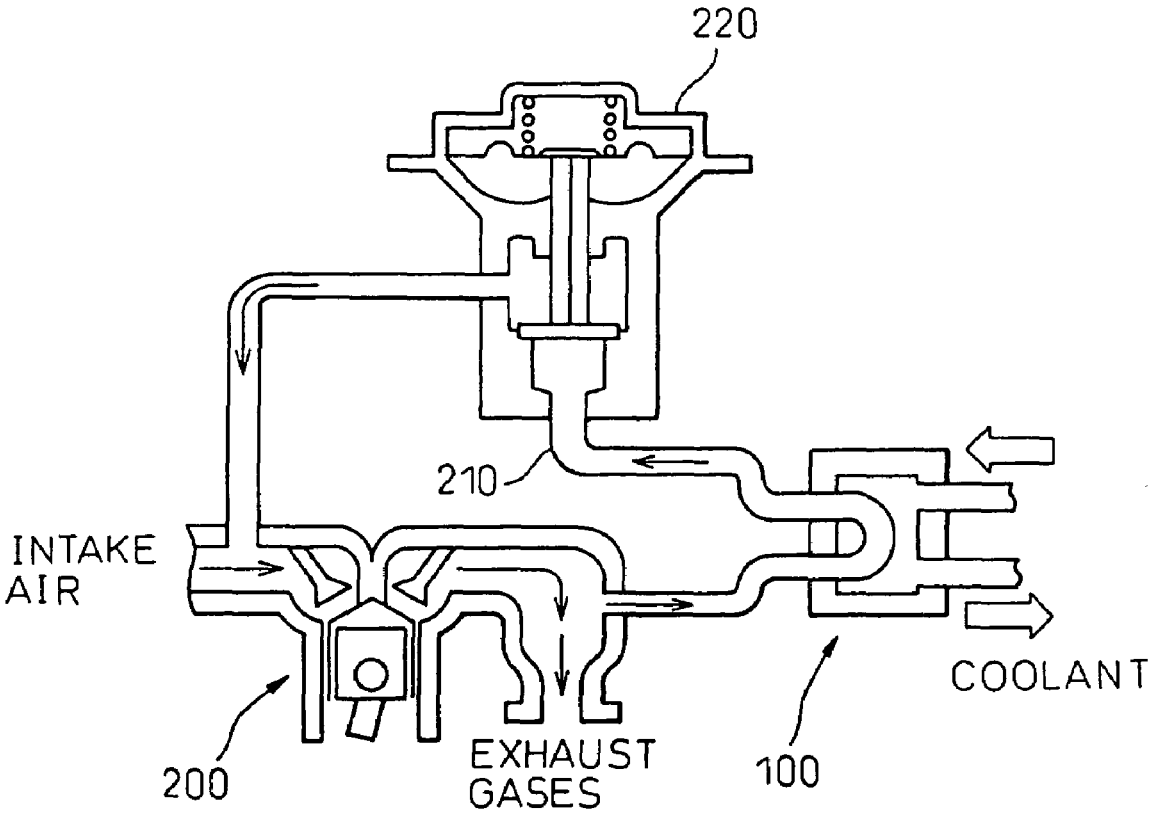
FIG. 1 is a view showing the type of an EGR-gas cooling system adopting an EGR-gas heat exchanger according to an embodiment of the invention.

Firstly, a first embodiment of the invention will be described. Hereinafter, embodiments of the invention will be described as an exhaust gas heat exchanging device according to the invention being applied to an EGR-gas cooling system for a diesel engine (an internal combustion engine). FIG. 1 is a view showing the type of an EGR (exhaust gas recirculation) system adopting an exhaust gas heat exchanger (hereinafter referred to as an "EGR-gas heat exchanger") 100 according to the invention. In FIG. 1, reference numeral 200 denotes a diesel engine, and reference numeral 210 denotes an exhaust gas recirculation pipe through which part of exhaust gases discharged from the engine 200 is passed to an intake side of the engine.

Reference numeral 220 denotes a known EGR valve disposed at an intermediate position along the length of the exhaust gas recirculation pipe 210 for regulating the volume of EGR gases according to the operating conditions of the engine 200. The EGR-gas heat exchanger 100 is disposed between an exhaust side of the engine 200 and the EGR valve 220 for implementing heat exchange between EGR gases and engine coolant (hereinafter, simply referred to as "coolant") to thereby cool the EGR gases.

Next, the construction of the EGR-gas heat exchanger 100 will be described.

Figure 2A:
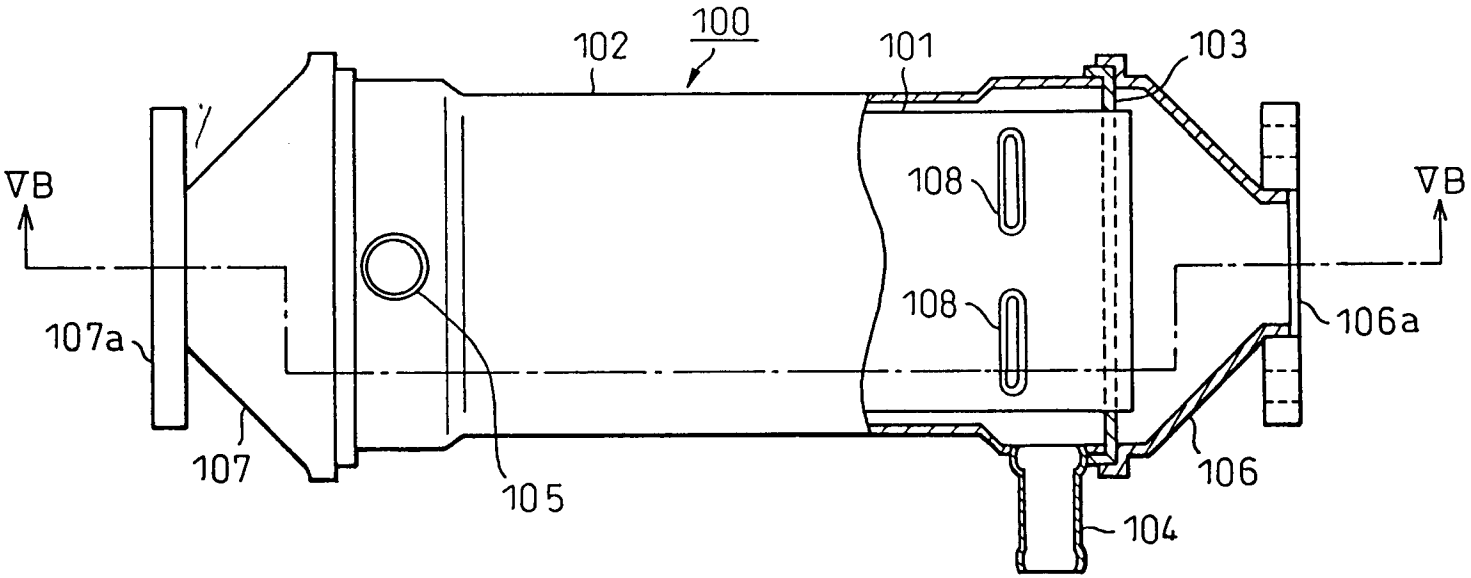
FIG. 2A is a partial cross sectional view of the EGR gas heat exchanger according to the embodiment of the present invention.
Figure 2B:
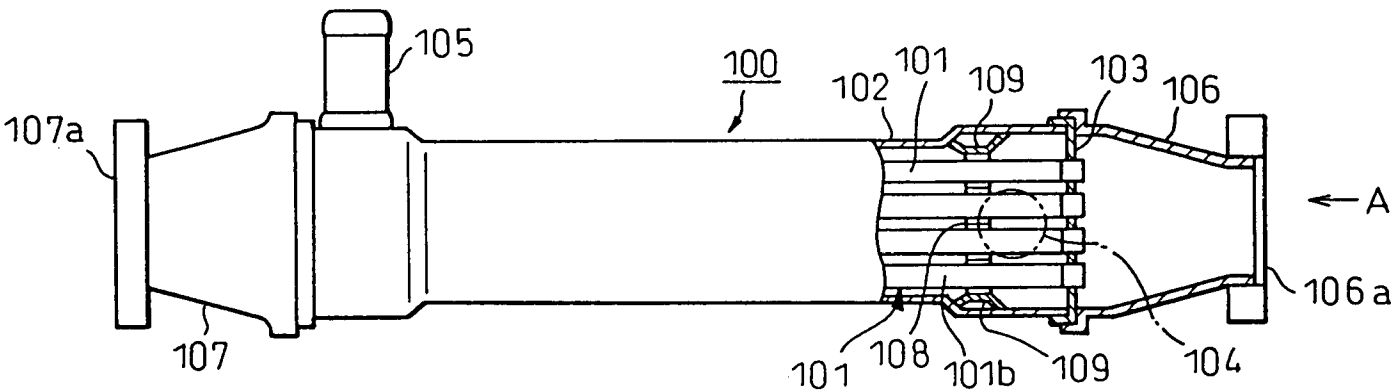
FIG. 2B is a partial cross sectional view of the EGR gas heat exchanger according to the embodiment of the present invention taken along line VB—VB in FIG. 2A.
Figure 4:
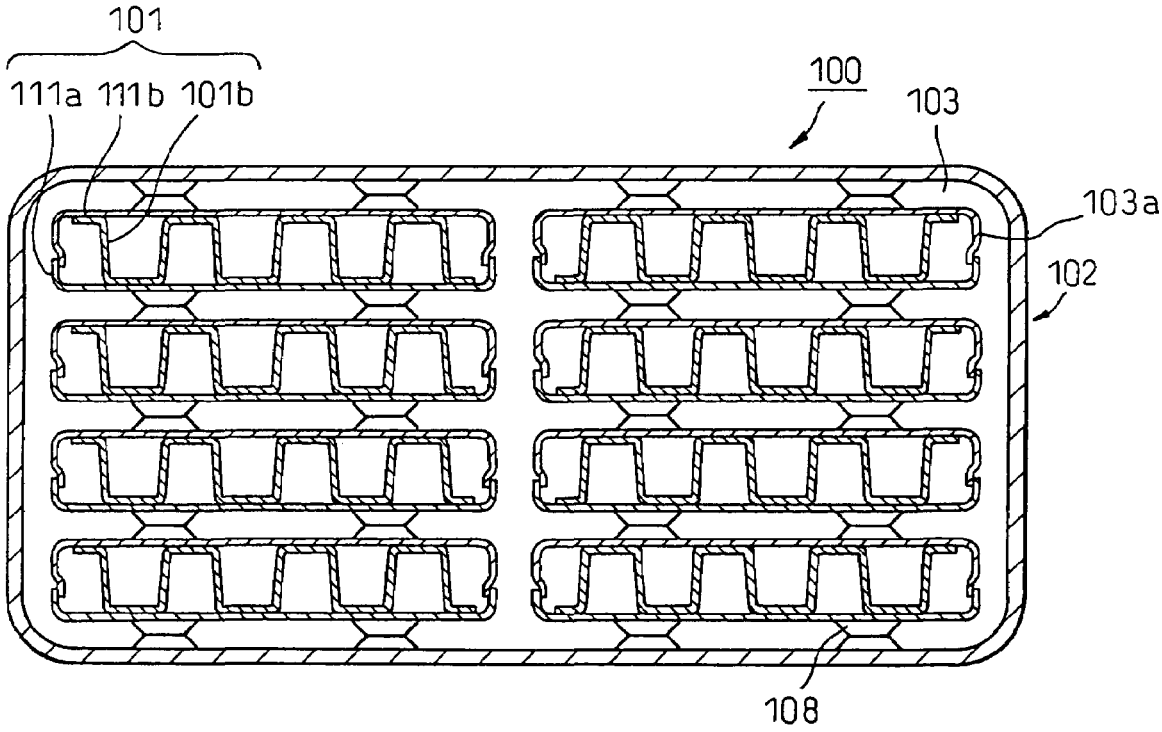
FIG. 4 shows a core plate as viewed from a direction A shown in FIG. 2.

FIG. 2 is a view showing the EGR-gas heat exchanger 100 according to the embodiment, and FIG. 4 is a view of a core plate as viewed from a direction A shown in FIG. 2. Reference numeral 101 denotes a tube in the interior of which exhaust gases flow and which has a flattened substantially rectangular cross section. A outwardly protruding rib 108 is formed on the surface of a wall of the tube 101. Ribs 108 formed on walls of tubes 101 which face each other abut with each other, so that not only is a gap between the respective tubes 101 maintained as a predetermined gap but also the pressure resistance of a coolant passage is increased.

Reference numeral 102 denotes a tubular tank which has a substantially rectangular cross section. Tubes 101 are stacked in such a manner that they become parallel to each other and are accommodated in the interior of the tank 102 in such a manner that the longitudinal direction of the tubes 101 and the longitudinal direction of the tank 102 coincide with each other, whereby a heat exchange core 110 is constructed.

The tank 102 is closed at the ends thereof by core plates 103. Openings 103*a* are formed in the core plates 103 and the ends of the respective tubes 101 which are accommodated in the interior of the tank 102 are passed through the openings 103*a* in the core plates 103.

A coolant inlet pipe 104 is connected to the tank 102 at a position in the vicinity of the core plate 103 on which the upstream ends of the tubes 101 are supported, and coolant flows into the interior of the tank 102 via this coolant inlet pipe 104. A coolant outlet pipe 105 is connected to the tank 102 at a position in the vicinity of the other end of the tank 102 through which coolant is allowed to flow to the outside of the tank. Thus, internal coolant passages are formed. The main stream of the coolant flows in the interior of the tank 102 in substantially the same direction as that of flows of exhaust gases which pass through the tubes 101.

Bonnets 106, 107 are connected to the longitudinal ends of the tank 102 which are opposite to the heat exchange core 110, and the core plates 103 are bent in directions opposite to the heat exchange core 110 in such a manner as to cover the circumferences of the bonnets 106, 107 and are joined thereto. An exhaust gas inlet 106*a* is formed in an end of the bonnet 106 disposed at the end of the tank 102 where the coolant inlet pipe 104 is connected for introducing exhaust gases into the bonnet 106, whereas an exhaust gas outlet 107*a* is formed in an end of the bonnet 107 disposed at the end of the tank 102 where the coolant outlet pipe 105 is connected for guiding exhaust gases to the outside of the bonnet 107. The bonnets 106, 107 each have a substantially quadrangular pyramid-like configuration in which the area of the flow path thereof gradually increases as they approach the heat exchange core 110, respectively, whereby exhaust gases are distributed to the respective tubes 101 properly.

In the EGR-gas heat exchanger 100, exhaust gases introduced from the exhaust gas inlet 106*a* pass through the bonnet 106 and then pass through the interior of the respective tubes 101. Exhaust gases cooled by coolant flowing around the tubes 101 then pass through the bonnet 107 and are discharged from the exhaust gas outlet 107*a*. On the other hand, coolant flows into the interior of the tank 102 via the coolant inlet pipe 104. In the interior of the tank 102, the coolant cools the exhaust gases passing through the tubes, and then flows to the outside of the tank 102 via the coolant outlet pipe 105.

Next, the construction of the tubes 101 will be described, the tubes 101 being a crucial portion of the invention.

Figure 3:
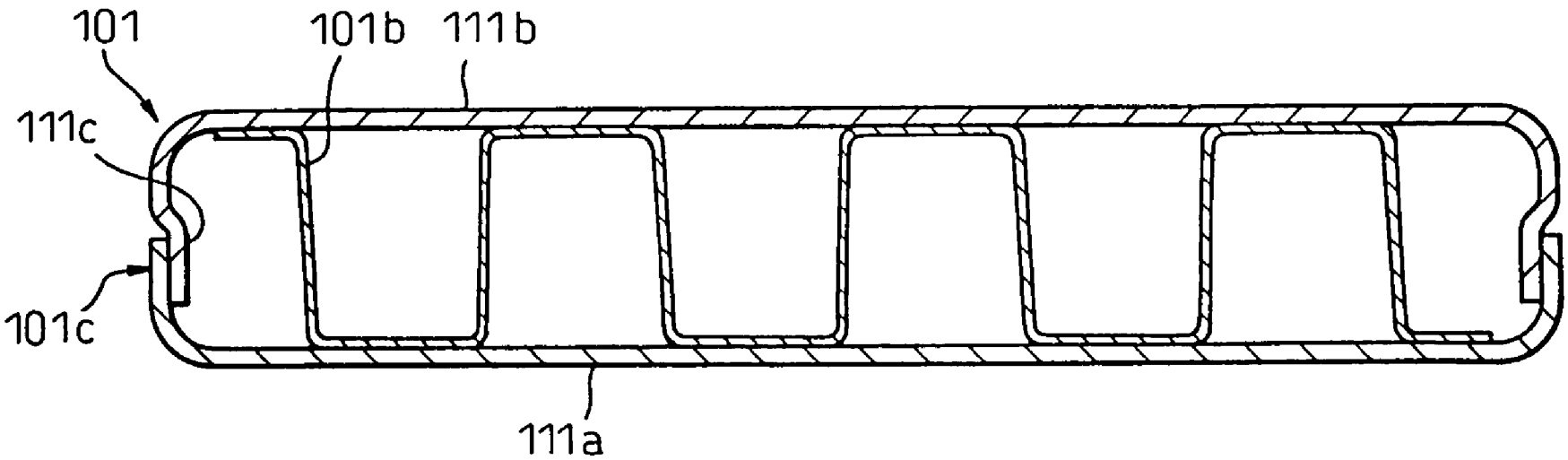
FIG. 3 is a transverse cross-sectional view of a tube according to a first embodiment of the invention.

FIG. 3 is a view showing a transverse cross section of the tube 101, and the tube 101 is constituted by an inner fin 101*b* made of a stainless steel and a pair of plates made of a stainless steel; a first plate 111*a* and a second plate 111*b*, which are caused to fit with each other to face vertically so that the inner fin 101*b* is put between the plate 111*a* and the plate 111*b*.

The inner fin 101*b* is formed into a substantially rectangular wave shape, and top portions of respective rectangular waves are brazed to an inner wall surface of the tube 101.

The respective plates 111*a*, 111*b* are bent at side edge portions thereof and each have a substantially U-shaped cross section. The side edge portions of the plates 111*a*, 111*b* are bent such that they overlap each other when the plates 111*a*, 111*b* fit on and in each other and constitute fitting portions 101*c*. An Ni brazing material in a paste form is thinly applied to the fitting portions, each constituting a joint portion by the brazing material. A difference in level 111*c* is formed at each of the fitting portions of the second plate which difference in level is substantially equal in height to the thickness of the first plate 111*a* and protrudes inwardly in the tube 101.

In addition, a paste-like brazing material of an Ni system, which has superior resistance to corrosion, is thinly applied to locations on the inner wall surfaces of the plates 111*a*, 111*b* to which the inner fin 101*b* is brazed, as well as to locations on the outer wall surface of the tube 101 which are brazed to the core plates 103.

Next, a method for producing the EGR-gas heat exchanger will be described.

The first and second plates 111*a*, 111*b* are caused to fit with each other in such a manner as to put the inner fin 101*b* between the plate 111*a* and the plate 111*b* to thereby fabricate the tube 101. As this occurs, the second plate 111*b* is fitted in the first plate 111*a* in such a manner that the second plate 111*b* is disposed inside the first plate 111*a* and that the plates face each other in a vertical direction. The tubes 101 are stacked in such a manner that the ribs 108 are brought into abutment with each other and are accommodated in the interior of the tank 102. The ends of the tubes 101 are passed through the core plates 103 and the core plates 103 are assembled to the tank 102 in such a manner as to close the tank 102 at the ends thereof. Following this, the bonnets 106, 107 are assembled to the core plates 103, respectively, and then the coolant inlet pipe 104 and the coolant outlet pipe 105 are assembled to the tank 102. Thus, after the respective members have been assembled together, brazing is implemented on the heat exchanger 100.

According to the embodiment, as the tube 101 is constructed by the first and second plates 111*a*, 111*b* which are fitted in each other in such a manner as to put the inner fin 101*b* between the first plate 111*a* and the second plate 111*b*, a risk of the brazing material being stripped off can be prevented when the inner fin 101*b*, and the first and second plates 111*a*, 111*b* are assembled together.

In addition, as the difference in level which protrudes inwardly is formed along each of the side edge portions of the second plate 111*b*, the fitting portions 101*c* become substantially as high as the outer wall surface of the second plate 111*b*, whereby the outer wall surface of the tube 101 can be a surface which is substantially level thereover. Due to this, when the tube 101 is passed through the core plates 103, only a minute gap is formed between an edge of the opening 103*a* in the core plate 103 and the outer wall surface of the tube 101. Thus, brazing of the tubes 101 to the core plates 103 can be ensured and a leakage resulting from a failure in brazing can be prevented from occurring between the coolant passage and the exhaust gas passages.

Furthermore, as the tube 101 is constructed by causing the first and second plates to fit with each other, the ribs 108 can be formed on both the first and second plates through press molding and no special process is required for forming the ribs 108.

In addition, the first and second plates 111*a*, 111*b* each have a U-shaped cross section and can be easily formed through press forming or the like.

Figure 5:
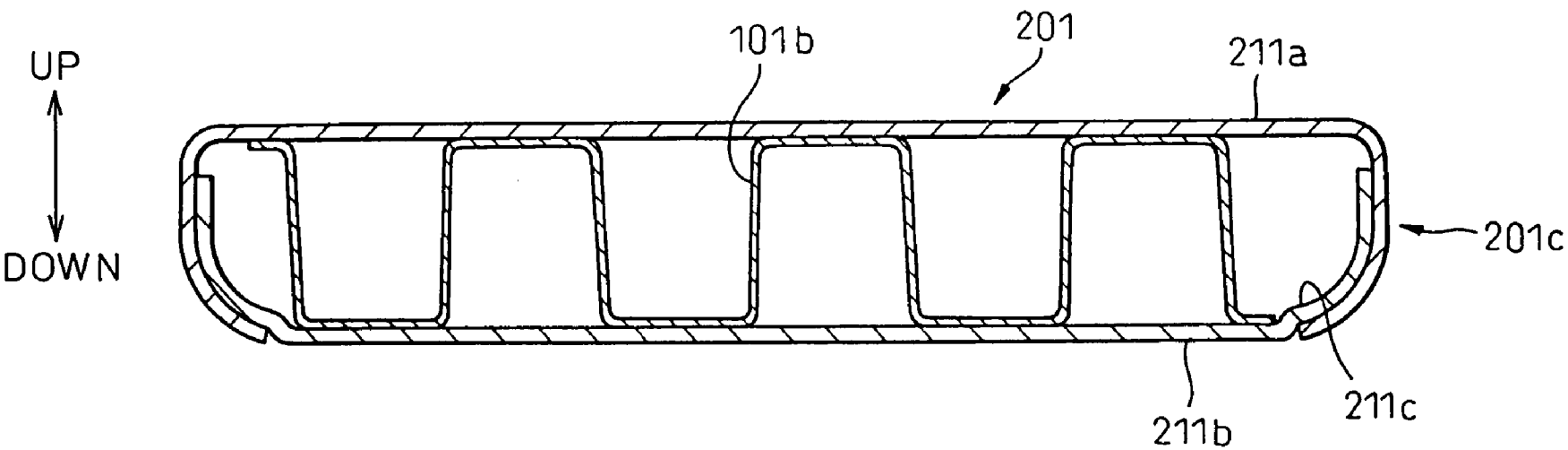
FIG. 5 is a transverse cross-sectional view of a tube according to a second embodiment of the invention.

Next, a second embodiment will be described. While the tube has been described in the aforesaid embodiment in which the plate disposed above is designed to fit inside, as shown in FIG. 5, a construction may be adopted in which a second plate 211*b* disposed below a pair of plates 211*a*, 211*b*, which constitute a tube 201, is allowed to fit inside. Note that when describing the second embodiment like reference numerals are used to denote constituent members similar to those described with respect to the first embodiment.

The ends of the first plate 211*a*, adapted to fit outside, are bent downwardly whereas ends of the second plate 211*b*, adapted to fit inside, are bent upwardly. As this occurs, the ends of the respective plates are bent such that an angle at which the ends of the first plate are bent becomes greater than an angle at which the ends of the second plate are bent. Note that the bent portions of the respective plates 211*a*, 211*b* constitute fitting portions 201*c* when both the first and second plates are caused to fit with each other.

The bent portions of the second plate 211*b* protrude inwardly of the tube 201 and a difference in level 211*c* is formed at each of the bent portions which is substantially equal to the thickness of the first plate 211*a*. The ends of the second plate 211*b* each have a length which is equal to or longer than about one half the height of the tube 201 (a width in a vertical direction as viewed in FIG. 5) and hence each have a sufficient brazing area. On the other hand, the ends of the first plate 211*a* are adapted to extend over the differences in level, respectively, when the first plate 211*a* is caused to fit on the second plate 211*b*.

Both the first and second plates 211*a*, 211*b* are caused to fit with each other such that the first plate 211*a* is positioned above and outside whereas the second plate 211*b* is positioned below and inside with an inner fin 101*b* being bracketed therein, and the first plate 211*a* positioned above is clamped to partially wrap the second plate 211*b*.

As the differences in level 211*c* are formed on the second plate 211*b* which protrude inwardly, similarly to the first embodiment, the outer wall surface of the tube 201 can be made substantially level thereover, and good brazing properties can be provided when brazing the tube 201 to core plates 103.

Incidentally, when exhaust gases pass through the tube 201, as the exhaust gases are cooled by coolant, there is produced condensate and there may be a case where condensate so produced remains in the interior of the tube 201. In the event that condensate comes to contact brazing surfaces of the fitting portions 211*c*, there may be a possibility that the brazing surfaces are corroded by corroding constituents contained in the condensate. According to the embodiment of the invention, however, the end portions of the second plate 211*b*, which is disposed inside, extend upwardly, and even if the condensate remains in the interior of the tube 201, the condensate is not allowed to be in contact with the brazing surfaces of the fitting portions 211*c*. As a result, the corrosion of the fitting portions 211*c* can be suppressed, and the resistance to corrosion of the EGR-gas heat exchanger can be increased.

In addition, according to the second embodiment, as the tube 201 has an asymmetrical configuration as viewed vertically, an assembling error can be prevented that would otherwise occur when the tube is passed through core plates 103 when it is assembled to a tank.

Next, a third embodiment will be described. While in the aforesaid embodiment the differences in level are formed on the plate which is adapted to be fittingly positioned inside and the joint potions of the plate adapted to be fittingly positioned outside are located on the differences in level, respectively, even if ends of the joint portions of the plate which is fittingly positioned outside are collapsed to be clamped to wrap up the differences in level formed on the plate which is fittingly positioned inside, so that the ends of the joint portions are configured to follow the outer wall surface of the tube, advantages similar to those provided by the first and second embodiments can be obtained. Note that like reference numerals are used to describe constituent members similar to those described with respect to the first embodiment.

Figure 6:
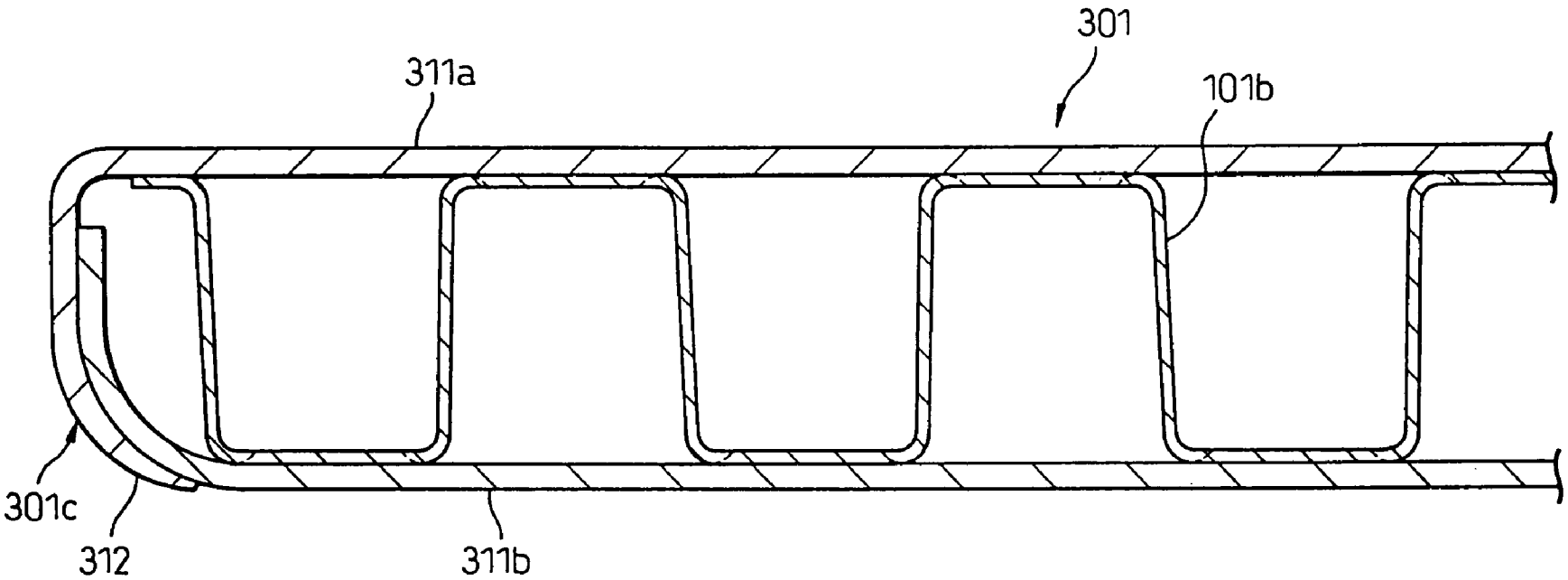
FIG. 6 is a partial transverse cross-sectional view of a tube according to a third embodiment of the invention.

FIG. 6 is a view showing a transverse cross section of a tube 301 according to the third embodiment of the invention, and first and second plates 311*a*, 311*b* are constructed substantially similarly to those of the second embodiment. However, there is formed no difference in level on the second plate 311*b* which is fitted inside. The first plate 311*a* disposed above reaches as far as bent portions of the second plate 311*b*, and distal ends of the first plate 311*a* are formed so as to be tapered, so that the ends thereof are formed in such a manner as to follow the bent portions of the second plate 311*b*. Owing to this, the outer wall surface of the tube 301 can be made substantially level, whereby good brazing properties can be provided when brazing the tube 301 to core plates 103.

Next, a fourth embodiment will be described. While in the aforesaid embodiments the tubes are formed by causing the first and second plates which have the different configurations to fit with each other, even if the tube is constructed by causing plates each having an identical configuration to fit with each other, an advantage can be obtained which is identical to those provided by the first embodiment. Note that like reference numerals are used to describe constituent members similar to those described with reference to the first embodiment.

Figure 7:
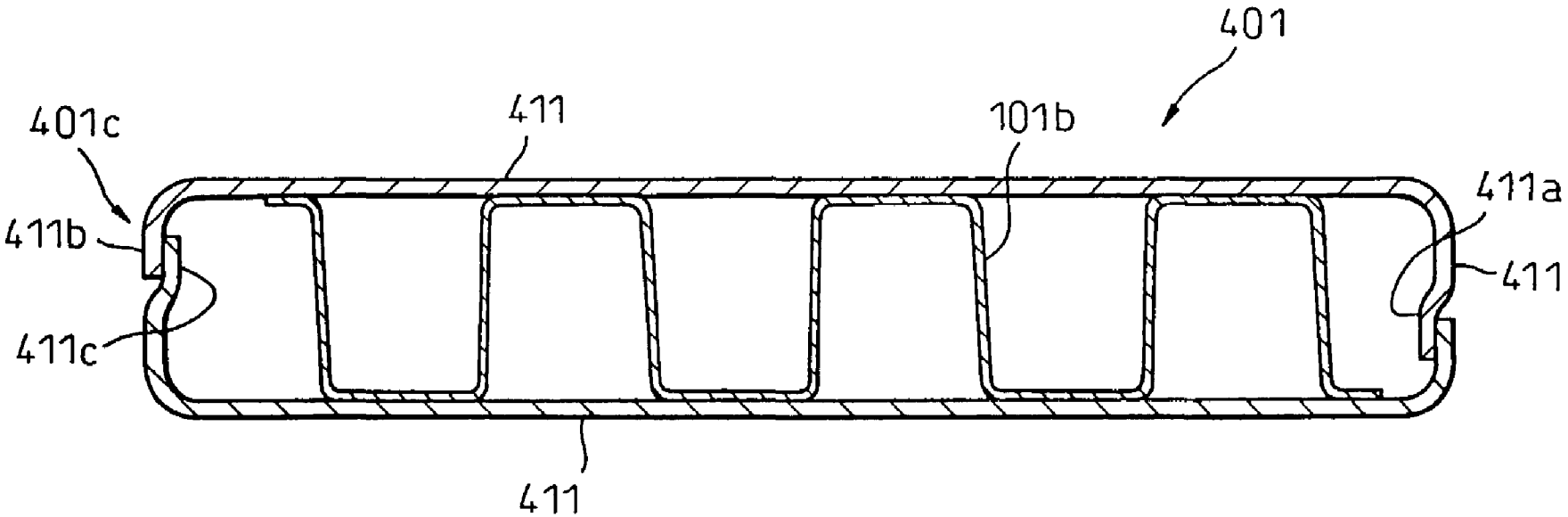
FIG. 7 is a transverse cross-sectional view of a tube according to a fourth embodiment of the invention.
Figure 8:
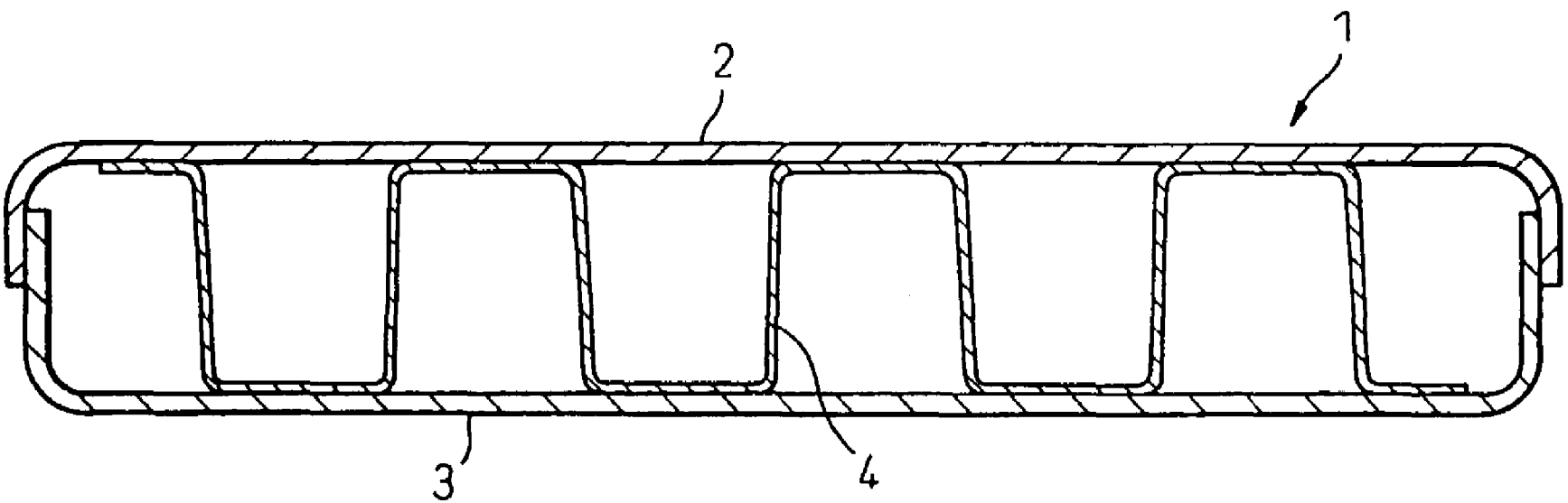
FIG. 8 is a transverse cross-sectional view of a tube according to the related art.

FIG. 7 is a view showing a transverse cross section of a tube 401 according to a fourth embodiment of the invention, and the tube 401 is formed by causing two plates 411 each having an identical configuration to fit with each other in such a manner as to face each other. Ends of the plate 411 are bent so that they constitute fitting portions when the plates 411 are fitted with each other. The bent portion 411*a* of the plate 411 is made longer the other bent portion 411*b* thereof and a difference in level 411*c* is formed on the end 411*a* which is substantially equal in height to the thickness of the plate 411 and which protrudes inwardly of the tube 401.

The end 411*a* of the plate 411 is fitted in the other end 411*b* of the other plate 411 to thereby form the tube 401. As this occurs, a state is created in which the end 411*b* is fitted in the difference in level 411*c*, whereby the outer wall surface of the tube 401 is made substantially level thereover. Owing to this, good brazing properties can be provided when brazing the tube 401 to core plates 103.

While the embodiments have been described as the tubes being stacked in a single row, tubes may be constructed such that they are stacked in a plurality of rows, and the numbers of tubes to be stacked and rows of stacked tubes are not limited to any specific numbers.

It goes without saying that the invention may be applied even if brazing materials other than brazing materials of an Ni system are used. In addition, even if a brazing material is sprayed or a brazing material in a sheet form is disposed as required instead of applying the paste-like brazing material, the same effect can be obtained.

While the invention has been described by reference to specific embodiments chosen for purposes of illustration, it should be apparent that numerous modifications could be made thereto by those skilled in the art without departing from the basic concept and scope of the invention.

What is claimed is:

1. An exhaust gas heat exchanger having a plurality of tubes which are stacked in such a manner as to become parallel with each other and through which exhaust gases from an internal combustion engine pass, a tank in which said plurality of tubes are accommodated, a coolant passage formed in the interior of said tank and constructed to allow coolant to flow around said plurality of tubes, bonnets coupled to ends of said plurality of tubes for distributing exhaust gases to said plurality of tubes or collecting exhaust gases that have passed through said plurality of tubes and core plates having openings through which the ends of said plurality of tubes are passed, respectively, and adapted to constitute partitions between said bonnets and said coolant passage and being brazed, said exhaust gas heat exchanger being characterized in that;

said tubes each comprise:

a first channel-shaped plate having a bottom wall and two planar transverse side edges extending generally perpendicular to the bottom wall of the first channel-shaped plate;

a second channel-shaped plate having a bottom wall and two transverse side edges extending generally perpendicular to the bottom wall of the second channel-shaped plate and interfitting closely within the planar transverse side edges of the first channel-shaped plate to form a generally rectangular enclosure, and inner fins disposed between said first plate and said second plate, a planar stepped portion formed generally perpendicular to the bottom wall of the second channel-shaped plate on each of said transverse side edges of said second channel-shaped plate on which said first plate is fitted, said planar stepped portion having a height substantially equal to the thickness of said planar transverse side edges of said first plate, and protruding inwardly of said tube.

2. An exhaust gas heat exchanger as set forth in claim 1, wherein said first channel-shaped plate and said second channel-shaped plate are fitted with each other in such a manner that said first and second plates face each other in a vertical direction and that said planar stepped portions of said second channel-shaped plate are disposed inside said planar transverse side edges of said first channel-shaped plate.

3. An exhaust gas heat exchanger as set forth in claim 2, wherein a transverse cross section of said tube has an asymmetrical configuration as viewed vertically.

4. An exhaust gas heat exchanger as set forth in claim 1, wherein said inner fin and said tube are brazed together with a brazing material of an Ni system applied to joint portions between said inner fin and said tube.

5. An exhaust gas heat exchanger as set forth in claim 1, wherein the tube has flat shape, the stepped portion is formed on the shorter side of the flat tube in the cross-section perpendicular to the longitudinal axis of the flat tube.

* * * * *